US009709277B2

(12) United States Patent
Keener et al.

(10) Patent No.: US 9,709,277 B2
(45) Date of Patent: Jul. 18, 2017

(54) FUEL PLENUM PREMIXING TUBE WITH SURFACE TREATMENT

(75) Inventors: Christopher Paul Keener, Woodruff, SC (US); Thomas Edward Johnson, Greenville, SC (US); Carl Robert Barker, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1084 days.

(21) Appl. No.: 13/471,488

(22) Filed: May 15, 2012

(65) Prior Publication Data

US 2013/0305734 A1 Nov. 21, 2013

(51) Int. Cl.
*F23R 3/28* (2006.01)

(52) U.S. Cl.
CPC ..... *F23R 3/286* (2013.01); *F23R 2900/00* (2013.01)

(58) Field of Classification Search
CPC ..... F23R 3/286–3/32
USPC ..... 60/737, 738
See application file for complete search history.

(56) References Cited

U.S. PATENT DOCUMENTS 3,662,578 A 5/1972 Gleason et al.
3,865,538 A * 2/1975 Quigg ..... 431/215
4,102,027 A 7/1978 Greever et al.
4,216,826 A 8/1980 Fujikake
4,313,248 A 2/1982 Fujikake
4,426,868 A 1/1984 Torniainen
6,053,209 A 4/2000 Wagner et al.
6,166,348 A 12/2000 Brundermann
7,104,067 B2 * 9/2006 Bunker ..... F23R 3/005 60/752
7,669,405 B2 * 3/2010 Pinard ..... F23R 7/00 60/247
7,743,821 B2 * 6/2010 Bunker ..... F28F 1/24 165/109.1
8,281,564 B2 * 10/2012 Zhang ..... F01K 23/10 122/367.3
2009/0242184 A1 10/2009 Mishima et al.
2010/0101229 A1 * 4/2010 York et al. ..... 60/737
2010/0252652 A1 * 10/2010 Johnson ..... F23D 14/62 239/132
2011/0113783 A1 * 5/2011 Boardman et al. ..... 60/723
2012/0006030 A1 1/2012 Uhm et al.
(Continued)

FOREIGN PATENT DOCUMENTS

CN 1732360 A 2/2006
CN 101725984 A 6/2010
CN 101858605 A 10/2010
(Continued)

OTHER PUBLICATIONS

U.S. Appl. No. 13/423,894, filed Mar. 19, 2012, Westmoreland, et al.
(Continued)

*Primary Examiner* — Laert Dounis
(74) *Attorney, Agent, or Firm* — Eversheds Sutherland (US) LLP

(57) ABSTRACT

The present application provides a micro-mixer fuel plenum for mixing a flow of fuel and a flow of air in a combustor. The micro-mixing fuel plenum may include an outer barrel and a number of mixing tubes positioned within the outer barrel. The mixing tubes may include one or more heat transfer features thereon.

12 Claims, 3 Drawing Sheets

(56) References Cited

U.S. PATENT DOCUMENTS

| | | | |
|---|---|---|---|
| 2012/0036856 | A1 | 2/2012 | Uhm et al. |
| 2012/0058437 | A1 | 3/2012 | Uhm et al. |

FOREIGN PATENT DOCUMENTS

| | | | |
|---|---|---|---|
| CN | 102061997 | A | 5/2011 |
| EP | 1 826 485 | A2 | 8/2007 |

OTHER PUBLICATIONS

U.S. Appl. No. 13/423,854, filed Mar. 19, 2012, Johnson, et al.
U.S. Appl. No. 13/425,950, filed Mar. 21, 2012, Melton, et al.
Chinese Office Action dated Apr. 5, 2016 for CN Application No. 201310178895.3, pp. 1-8.
Extended Search Report issued in European Patent Appln. No. 13167869, dated Feb. 1, 2017, 8 pages.

* cited by examiner

FUEL PLENUM PREMIXING TUBE WITH SURFACE TREATMENT

TECHNICAL FIELD

The present application and the resultant patent relate generally to gas turbine engines and more particularly relate to a fuel plenum premixing tube with surface treatment thereon for use in a micro-mixer and the like for improved and uniformed temperature distribution.

BACKGROUND OF THE INVENTION

Operational efficiency and output of a gas turbine engine generally increases as the temperature of the hot combustion gas stream increases. High combustion gas stream temperatures, however, may produce high levels of nitrogen oxides ($NO_x$) and other types of regulated emissions. A balancing act thus exists between operating a gas turbine engine in an efficient temperature range while also ensuring that the output of nitrogen oxides and other types of regulated emissions remain below mandated levels.

Lower emission levels of nitrogen oxides and the like may be promoted by providing for good mixing of the fuel stream and the air stream before combustion. Such premixing tends to reduce combustion temperatures and the output of nitrogen oxides. One method of providing such good mixing is through the use of micro-mixers where the fuel and the air are mixed in a number of micro-mixing tubes within a plenum. In order to promote such good mixing, the same amount of fuel should be delivered to each mixing tube. This objective, however, may be challenging because fuel density is in part a function of temperature. Given such, ensuring that the fuel delivered to each tube has a uniform heat pickup may be difficult. Moreover, a significant temperature difference may develop between the mixing tubes and the outer barrel of the plenum. This temperature differential may lead to component distortion over time as well as a reduced component life.

There is thus a desire for a combustor with an improved micro-mixer design. Such an improved micro-mixer design may promote good fuel-air mixing while providing a more uniform thermal distribution across the mixing tubes and the outer barrel.

SUMMARY OF THE INVENTION

The present application and the resultant patent thus provide a micro-mixer fuel plenum for mixing a flow of fuel and a flow of air in a combustor. The micro-mixing fuel plenum may include an outer barrel and a number of mixing tubes positioned within the outer barrel. The mixing tubes may include one or more heat transfer features thereon.

The present application and the resultant patent further provide a method of promoting a uniform temperature distribution across a micro-mixer fuel plenum with a number of mixing tubes. The method may include the steps of flowing air at a first temperature through the mixing tubes in a first direction, flowing fuel at a second temperature across one or more heat transfer features on the mixing tubes in a second direction, exchanging heat between the flowing air and the flowing fuel across the heat transfer features, and flowing the fuel into the mixing tubes through a number of post orifices.

The present application and the resultant patent further provide a micro-mixer fuel plenum for mixing a flow of fuel and a flow of air in a combustor. The micro-mixer fuel plenum may include an outer barrel for introducing the flow of fuel and a number of mixing tubes positioned within the outer barrel for introducing the flow of air. The mixing tubes may include a number of post orifices and one or more heat transfer features thereon to exchange heat between the flow of fuel and the flow of air before the flow of fuel enters the post orifices.

These and other advantages and improvements of the present application and the resultant patent will become apparent to one of ordinary skill in the art upon review of the following detailed description when taken in conjunction with the several drawings and the appended claims.

DETAILED DESCRIPTION

Figure 1:
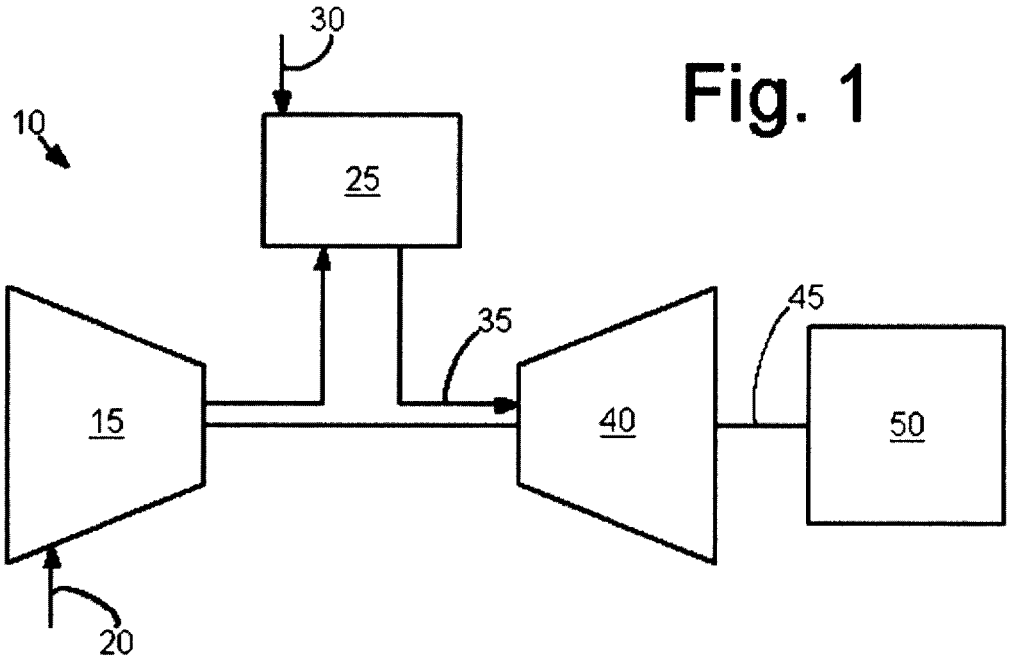
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of the combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
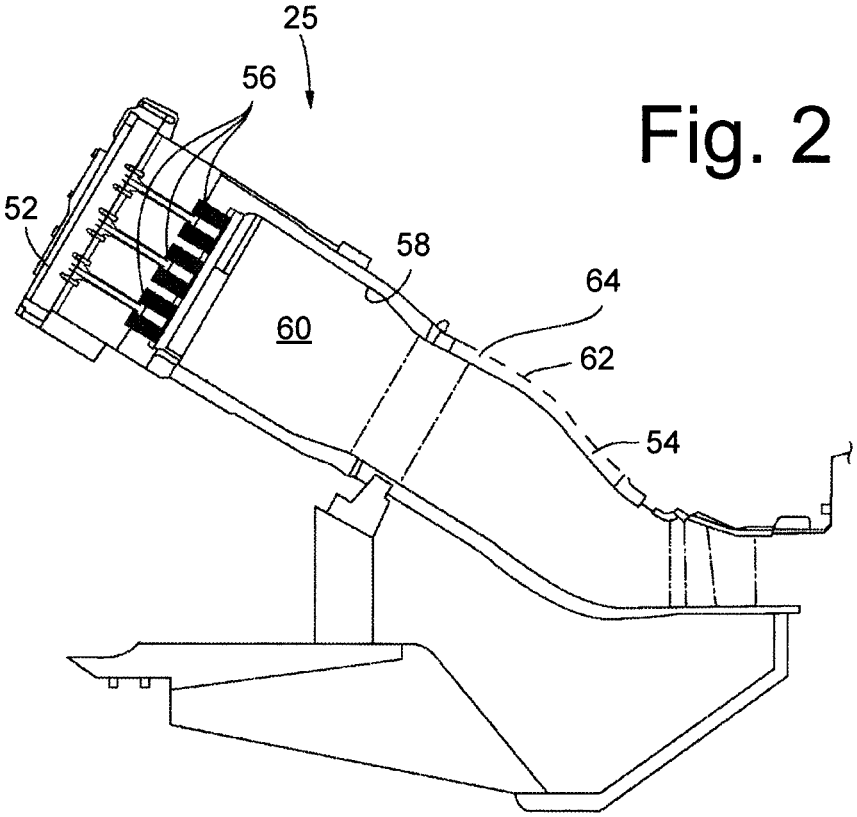
FIG. 2 is a schematic diagram of a combustor as may be used with the gas turbine engine of FIG. 1.

FIG. 2 shows a schematic diagram of an example of the combustor 25 as may be used with the gas turbine engine 10 described above. The combustor 25 may extend from an end cap 52 at a head end to a transition piece 54 at an aft end about the turbine 40. A number of fuel nozzles 56 may be positioned about the end cap 52. A liner 58 may extend from the fuel nozzles 56 towards the transition piece 54 and may define a combustion zone 60 therein. The liner 58 may be surrounded by a flow sleeve 62. The liner 58 and the flow sleeve 62 may define a flow path 64 therebetween for the flow of air 20 from the compressor 15 or otherwise. The combustor 25 described herein is for the purpose of example only. Combustors with other components and other configurations may be used herein.

Figure 3:
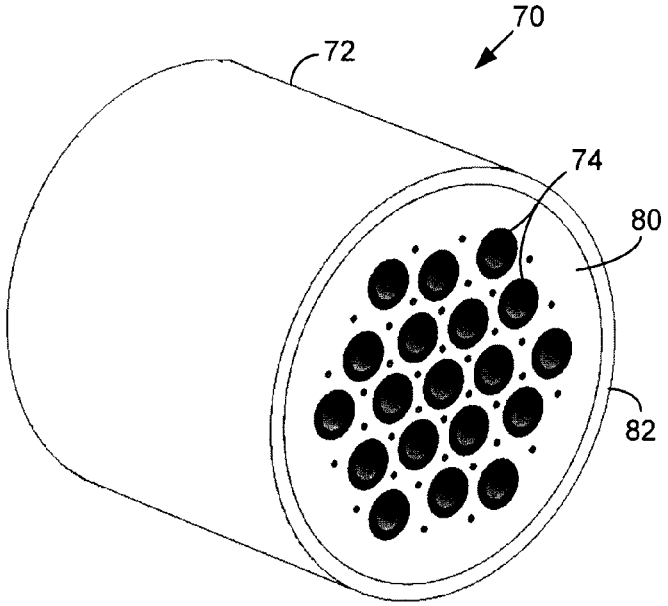
FIG. 3 is a perspective view of a micro-mixer fuel plenum as may be used in the combustor of FIG. 2.
Figure 4:
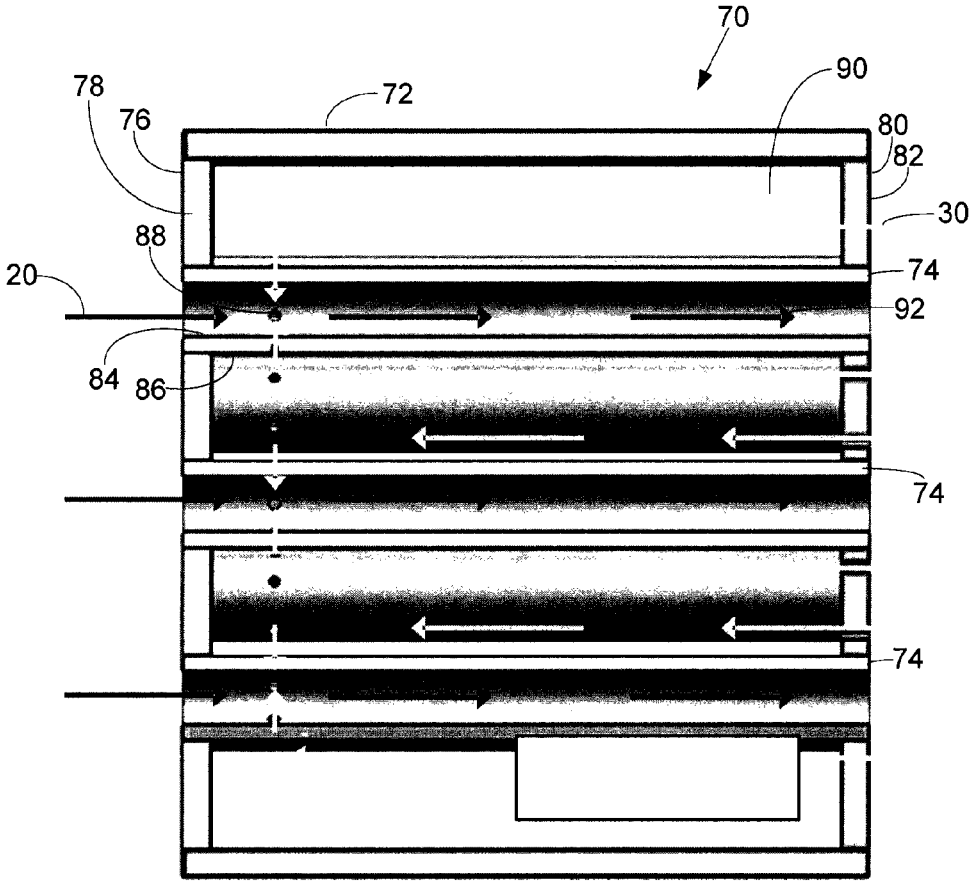
FIG. 4 is a side cross-sectional view of the micro-mixer fuel plenum of FIG. 3.

FIGS. 3 and 4 show an example of a micro-mixer fuel plenum 70. The micro-mixer fuel plenum 70 may be used about the fuel nozzles 56 or otherwise. As described above, the micro-mixer fuel plenum 70 may include an outer barrel 72 with a number of mixing tubes 74 therein. The mixing tubes 74 may extend from and through a boundary plate 76 on a first end 78 to and through a fuel distribution plate 80 on a second end 82 thereof. Any number of the mixing tubes 74 may be used herein in varying configurations. The outer barrel 72 and the mixing tubes 74 may have any size, shape, or configuration. Each of the mixing tubes 74 may have an inner surface 84 and an outer surface 86. Each mixing tube 74 also may include a number of post orifices 88 extending from the outer surface 86 to the inner surface 84. Any number of the post orifices 88 may be used in any size, shape, or configuration. The space between the mixing tubes 74 and the outer barrel 72 may define a fuel space 90 therein for the introduction of the flow of fuel 30.

In use, the flow of fuel 30 enters the micro-mixer fuel plenum 70 from the second end 82 through the fuel distribution plate 80 and flows along the outer surface 86 of the mixing tubes 74 in the fuel space 90. The flow of fuel 30 may be at a temperature $T_{FUEL}$ in the range of about 80 degrees to about 400 degrees Fahrenheit (about 26.7 degrees to about 204.4 degrees Celsius). The flow of air 20 enters the mixing tubes 74 at the first end 78. The flow of air 20 from the compressor 15 may be at a compressor discharge temperature, $T_{CD}$, on the order of about 700 degrees to about 900 degrees Fahrenheit (about 371.1 degrees to about 782.2 degrees Celsius). The flow of fuel 30 flows through the post orifices 88 and mixes with the flow of air 20 to form a fuel/air mixture 92. The fuel/air mixture 92 then exits the mixing tube 74 about the second end 82.

The flow of air 20 also surrounds the outer barrel 72 of the micro-mixer fuel plenum 70 at about temperature $T_{CD}$. As described above, the outer barrel 72 thus is exposed to both temperatures $T_{CD}$ and $T_{FUEL}$. As such, the outer barrel 72 may be on the order of about 500 degrees to about 600 degrees Fahrenheit (about 260 degrees to about 315.6 degrees Celsius) such that the mixing tube 74 may be relatively hot while the outer barrel 72 may be relatively cooler. Other temperatures and other types of temperature differentials also may be accommodated herein.

The flow paths required for the flows of fuel 30 to reach each post orifice 88 thus may be unique such that the amount of heat pickup may vary about each mixing tube 74. Because density is a function of temperature, this non-uniformity may cause the amount of fuel delivered to each mixing tube 74 to vary accordingly. As described above, this variability may negatively impact emissions, flame holding, and overall performance and output. Likewise, the temperature differences between the mixing tubes 74 and the outer barrel 72 may result in a thermal mismatch therebetween such that the mixing tubes 74 may be in compression and may be plastically deformed. Such a temperature differential thus may result in component distortion and possibly damage over an extended period of time and use.

Figure 5:
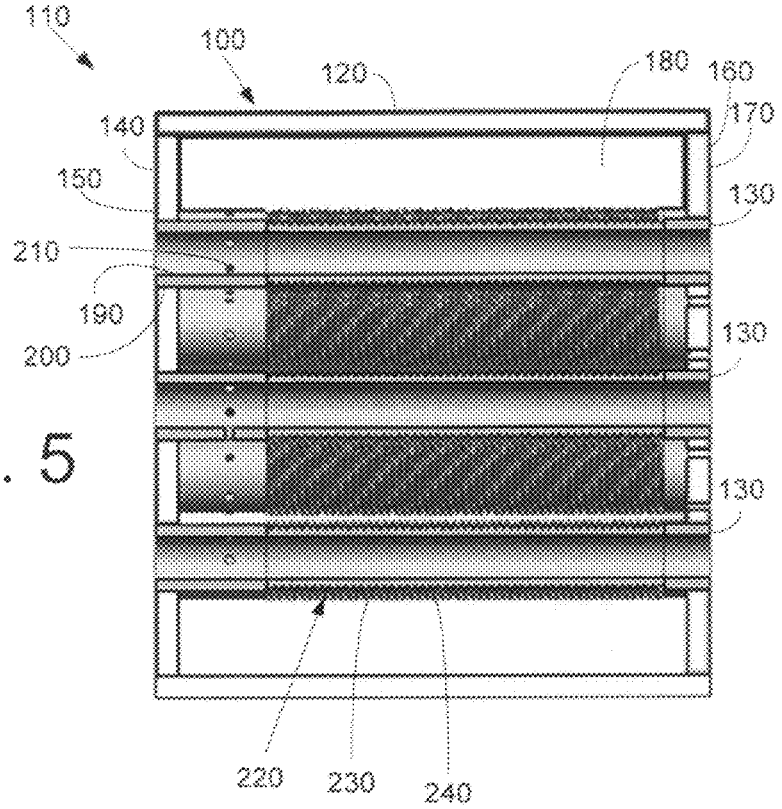
FIG. 5 is a side cross-sectional view of a micro-mixer fuel plenum as may be described herein.

FIG. 5 shows a side cross-sectional view of a micro-mixer fuel plenum 100 as may be described herein for use in a combustor 110 and the like. The micro-mixer fuel plenum 100 may include an outer barrel 120 with a number of mixing tubes 130 therein. Any number of mixing tubes 130 may be used herein. The outer barrel 120 and the mixing tubes 130 may have any size, shape, or configuration. The mixing tubes 130 may extend from and through a boundary plate 140 at a first end 150 to and through a fuel distribution plate 160 at a second end 170. The space between the mixing tubes 130 and the outer barrel 120 may define a fuel space 180 therein. The mixing tubes 130 may include an inner surface 190 and an outer surface 200. A number of post orifices 210 may extend from the outer surface 200 to the inner surface 190. Any number of the post orifices 210 may be used in any size, shape, or configuration. Other components and other configurations may be used herein.

The outer surfaces 200 of some or all of the mixing tubes 130 thus may have one or more heat transfer features 220 formed therein. In this example, the heat transfer features 220 may be one or more recessed heat transfer features 230. The recessed heat transfer features 230 may be in the form of one or more threads 240 and the like. The recessed heat transfer features 230 may be formed by machining the threads 240 therein or by otherwise forming such recesses heat transfer features 230 into the outer surface 200 of the mixing tubes 130. Any number of the recessed heat transfer features 230 and the threads 240 may be used in any size, shape, or configuration. Other components and other configurations may be used herein.

Figure 6:
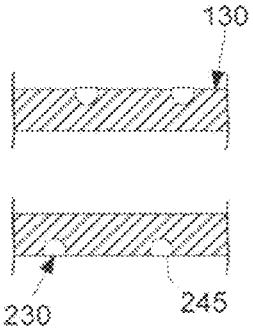
FIG. 6 is a plan view of a portion of an alternative embodiment of a micro-mixer fuel plenum as may be described herein.

FIG. 6 shows a further example of the recessed heat transfer features 230. In this example, the recessed heat transfer features 230 may be in the form of a number of dimples 245. The dimples 245 may be formed in the outer surface 200 of one or more of the mixing tubes 130. Any number of the recessed heat transfer features 230 and the dimples 245 may be used herein in any size, shape, or configuration. The recessed heat transfer features 230 may take many other and different shapes in addition to the threads 240, the dimples 245, and the like. Other components and other configurations may be used herein.

Figure 7:
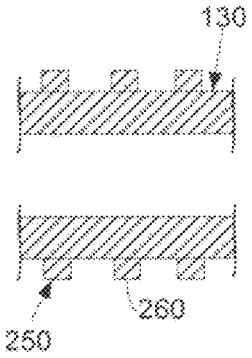
FIG. 7 is a plan view of a portion of an alternative embodiment of a micro-mixer fuel plenum as may be described herein.
Figure 8:
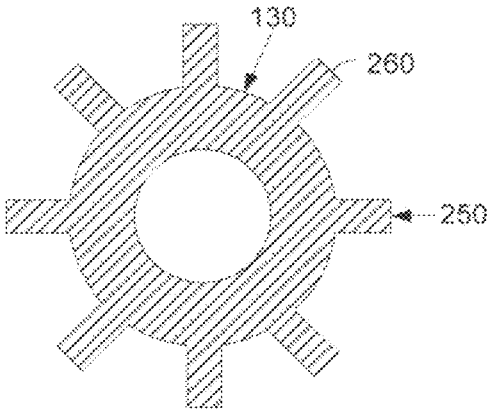
FIG. 8 is a side cross-sectional view of a mixing tube as may be used in the micro-mixer fuel plenum of FIG. 7.

FIGS. 7 and 8 show a further example of the heat transfer features 220. In this example, the heat transfer features 220 may include a number of protruding heat transfer features 250 formed on one or more of the mixing tubes 130. The protruding heat transfer features 250 may be in the form of one or more ribs 260 or other type of outward protrusion. The ribs 260 may extend in an axial and/or radial direction. The protruding heat transfer features 250 may be formed by extending or forming the ribs 260 or other type of protrusion from the outer surface 200 of the mixing tubes 130. Any number of the protruding heat transfer features 250 and the ribs 260 may be used in any size, shape, or configuration. The protruding heat transfer features 250 may take many other and different shapes in addition to the ribs 260 and the like. Other components and other configurations may be used herein.

The use of the heat transfer features 220 thus increases the surface area of the mixing tubes 130 so as to increase the amount of heat transferred to the flows of fuel 30 before the flows enter the post orifices 210. Specifically, the heat transfer features 220 promote uniformity in temperature distribution at the post orifices 210. By increasing the amount of heat pickup across the heat transfer features 220, the temperature of the flow of fuel 30 may approach a maximum value such that the fuel temperature $T_{FUEL}$ at the post orifices 210 may be substantially uniform. Likewise, increasing the amount of heat pulled out of the flow of air 20 in the mixing tubes 130 may result in a more favorable temperature distribution between the mixing tubes 130 and the outer barrel 120. By adding the heat transfer features 220 to the outer surface 200 of the mixing tube 130, the mixing tubes 130 also may become more compliant in addition to becoming cooler. Both of these outcomes improve the durability of the mixing tubes 130 and also unloads the joint between the mixing tubes 130 and the barrel 120.

The configuration of the heat transfer features 220 may vary and may be based upon the amount of heat pickup targeted and the allowable stresses herein. Given such, the heat transfer features 220 may be any number and type of the recessed heat transfer features 230 and/or the protruding heat transfer features 250 and/or combinations thereof. Other types of heat transfer features 220 also may be used herein. Specifically, any structure that increases the overall surface area of the mixing tubes 130 and the like so as to increase the amount of heat transferred may be used herein in any orientation or configuration. The use of the heat transfer features 220 herein thus promotes fuel uniformity across the components herein without adding additional complexity or operational costs.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A micro-mixer fuel plenum for mixing a flow of fuel and a flow of air in a combustor, comprising:

an outer barrel; and a plurality of mixing tubes positioned within the outer barrel, wherein the plurality of mixing tubes comprises an outer surface, an inner surface, a first end, and a second end;

the plurality of mixing tubes comprising a plurality of ribs and a plurality of dimples having curved profiles;

wherein the plurality of dimples are formed in between the outer surface and the inner surface, the plurality of dimples positioned in an offset formation across the outer surface, such that a first set of dimples on a first side of the outer surface are in an offset position with respect to a second set of dimples on a second side of the outer surface, and wherein none of the dimples on the first side are aligned with dimples on the second side, wherein the second side is opposite the first side; and wherein the plurality of ribs are positioned on the outer surface of the plurality of mixing tubes and extend along a central axis of the plurality of mixing tubes.

2. The micro-mixer fuel plenum of claim 1, wherein the plurality of mixing tubes extends from a boundary plate at a first end of the outer barrel to a fuel distribution plate at a second end of the outer barrel.

3. The micro-mixer fuel plenum of claim 1, wherein the outer barrel comprises a fuel space therein for the flow of fuel.

4. The micro-mixer fuel plenum of claim 1, wherein the plurality of mixing tubes comprises a plurality of post orifices for the flow of fuel.

5. The micro-mixer fuel plenum of claim 4, wherein the flow of fuel comprises a maximum temperature about the plurality of post orifices of each of the plurality of mixing tubes.

6. The micro-mixer fuel plenum of claim 4, wherein the flow of fuel comprises a substantially uniform temperature about the plurality of post orifices of each of the plurality of mixing tubes.

7. The micro-mixer fuel plenum of claim 1, wherein the plurality of ribs are protruding heat transfer features.

8. The micro-mixer fuel plenum of claim 7, wherein the plurality of ribs extend along a length of the plurality of mixing tubes.

9. A method of promoting a uniform temperature distribution across a micro-mixer fuel plenum with a plurality of mixing tubes, comprising:

flowing air at a first temperature through the plurality of mixing tubes in a first direction;

flowing fuel at a second temperature across a first dimple on a first side of an outer surface in a second direction;

flowing fuel at the second temperature across a second dimple on a second side of the outer surface in the second direction, wherein the second dimple is offset with respect to the first dimple, and the second side is opposite the first side;

exchanging heat between the flowing air and the flowing fuel across a plurality of ribs and a plurality of dimples comprising the first dimple and the second dimple, the plurality of dimples having curved profiles such that a surface area is increased, wherein none of the dimples on the first side are aligned with the dimples on the second side; and flowing the fuel into the plurality of mixing tubes via a plurality of post orifices.

10. A micro-mixer fuel plenum for mixing a flow of fuel and a flow of air in a combustor, comprising:

an outer barrel for introducing the flow of fuel; and a plurality of mixing tubes positioned within the outer barrel for introducing the flow of air, wherein the plurality of mixing tubes comprises an outer surface and an inner surface;

the plurality of mixing tubes comprising a plurality of post orifices, an outer surface, an inner surface, a first end, and a second end; and the plurality of mixing tubes comprising a plurality of ribs and a plurality of dimples about the outer surface to exchange heat between the flow of fuel and the flow of air before the flow of fuel enters the plurality of post orifices, wherein the plurality of dimples is formed in the outer surface and has a curved profile, and wherein the plurality of dimples is positioned in an offset formation across the outer surface, such that a first set of dimples on a first side of the outer surface are in an offset position with respect to a second set of dimples on a second side of the outer surface, wherein none of the dimples on the first side are aligned with dimples on the second side, and wherein the plurality of ribs are positioned on the outer surface of the plurality of mixing tubes and extend along a central axis of the plurality of mixing tubes.

11. The micro-mixer fuel plenum of claim 10, wherein the plurality of mixing tubes extends from a boundary plate at a first end of the outer barrel to a fuel distribution plate at a second end of the outer barrel.

12. The micro-mixer fuel plenum of claim 10, wherein the plurality of ribs are protruding heat transfer features.

* * * * *